United States Patent [19]

Prochhorst

[11] Patent Number: 4,981,540

[45] Date of Patent: Jan. 1, 1991

[54] METHOD OF SECURING PILING LOCKS

[75] Inventor: Manfred Prochhorst, Dortmund, Fed. Rep. of Germany

[73] Assignee: Hoesch Stahl Aktiengesellschaft, Dortmund, Fed. Rep. of Germany

[21] Appl. No.: 347,768

[22] Filed: May 4, 1989

[30] Foreign Application Priority Data

May 5, 1988 [DE] Fed. Rep. of Germany ..... 3815236

[51] Int. Cl.[5] ..... E02D 5/08; E02D 5/14; E02D 7/02

[52] U.S. Cl. ..... 156/157; 156/293; 156/304.5; 405/278; 405/279

[58] Field of Search ..... 156/305, 157, 293, 304.5; 405/274, 276, 278, 279, 281

[56] References Cited

U.S. PATENT DOCUMENTS

| | | | |
|---|---|---|---|
| 1,937,758 | 12/1933 | Harris | 405/279 |
| 3,302,412 | 2/1967 | Hunsucker | 405/279 |

FOREIGN PATENT DOCUMENTS

| | | | |
|---|---|---|---|
| 2002799 | 2/1974 | Fed. Rep. of Germany . | |
| 3041440 | 2/1982 | Fed. Rep. of Germany . | |
| 428297 | 5/1935 | United Kingdom | 405/279 |

*Primary Examiner*—Michael G. Wityshyn
*Attorney, Agent, or Firm*—Max Fogiel

[57] ABSTRACT

In a method of securing piling locks in order to transmit thrust, an adhesive is applied between the surfaces of the interlocking halves (1 & 5) of the lock that come into contact with each other in the inside (4) of the lock.

2 Claims, 3 Drawing Sheets

METHOD OF SECURING PILING LOCKS

Figure 1:
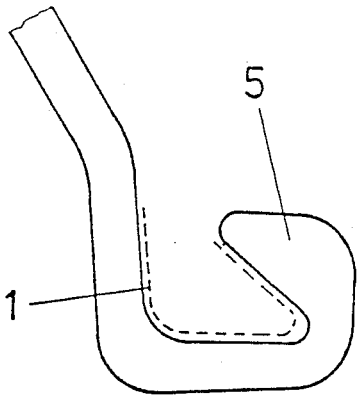

The invention concerns a method of securing piling locks in order to transmit thrust, whereby an adhesive is applied between the surfaces of the interlocking halves of the lock that come into contact with each other inside it. The securing process is intended to prevent the sheet piles from mutually sliding back and forth.

Sheet piles are usually not driven in individually but are previously combined at the factory into double or triple sheets called driving units. Securing together the locks on sheet piles that are combined into such units at the factory by welding or crimping is known. It is, however, impossible to secure the driving-unit locks, the locks applied to the driving units to connect them together on site, in this way. It is technically impossible to unexceptionably weld the driving-unit locks together to prevent them from slipping below the ground level of a harbor, canal, or building-excavation construction site or below the water level of a canal, river, or harbor, and the finished weld will not fulfill its purpose subject to the load that is typical for sheet piling.

A method of manufacturing multiple sheet piles whereby the locks applied in the factory are secured to each other with adhesive to prevent them from sliding is known (German AS No. 2 002 799). Once the adjacent locks have been hooked together, the longitudinal outer gaps are sealed to allow the pressurized injection of an adhesive inside them and the overall connection is maintained motionless until the adhesive can cure. This procedure, however, can only be carried out at the factory.

In another known method, a curing mass is introduced by means of a hose or pipe that extends to the bottom of the particular hollow space (German OS No. 3 041 440). The purpose is to create a wall that will block out soil and/or water.

The object of the present invention is to improve a method of the type initially described to the extent that it can be employed not only with the locks on the driving units connected together at the factory but also with the driving unit locks, ensuring unexceptionable transmission of thrust in the on-site threaded lock.

The method employed to attain this object in accordance with the invention consists of introducing the adhesive into the forward half of the lock before the driving unit is driven in, applying a caliber piece to the half to protect the adhesive and keep soil out of the inside of the lock, and extracting the caliber piece once the driving unit has been driven all the way in. This characteristic of the method accordance with the invention makes it possible to apply the adhesive even below the water table or in the open water.

The curing time can be decelerated or accelerated either above or below the water, depending on the type of adhesive.

The adhesive preferably consists of an environmentally safe and combustion-resistant material, and also of cement or mixtures of cement for example.

In addition to unexceptionably securing the piling locks together, the method in accordance with the invention also seals the sheet piling very tight, so that no additional measures are necessary to seal it.

Another characteristic of the method in accordance with the invention consists of applying a caliber piece that has a pipe with nozzles mounted on it to the forward half of the lock before the driving unit is driven in and of extracting the caliber piece while simultaneously injecting the adhesive through the nozzles on the pipe once the driving unit has been driven all the way in.

Figure 1A:
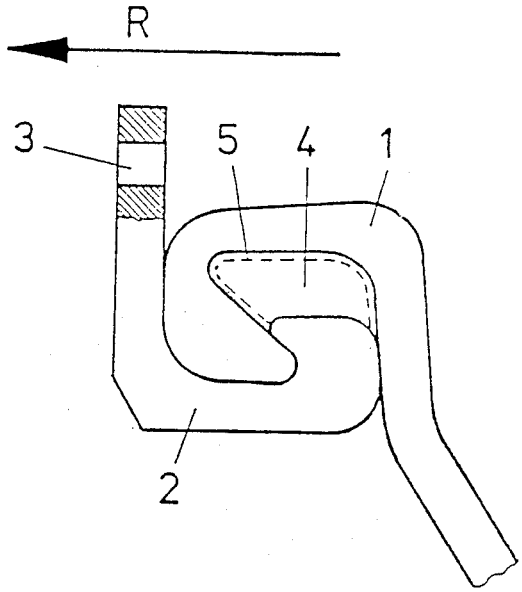

The invention will now be described in detail with reference to the drawing, which consists of top views of different piling locks, whereby FIG. 1 shows the halves of a lock that connects two driving units, next to each other, FIG. 1*a* shows the lock of FIG. 1 in combination with a caliber member.

Figure 2:
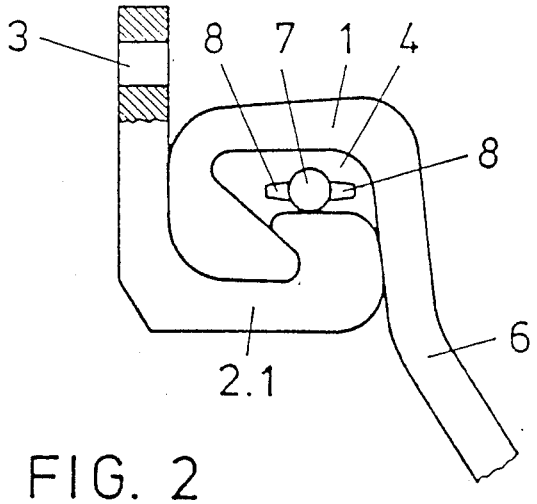

FIG. 2 shows the forward half of a lock on one driving unit, and

FIGS. 3 to 7 each show a sheet-piling lock.

Inserted into the forward half 1 of the sheet-piling lock illustrated in FIG. 1 is a caliber piece 2 that has a bore 3 for extracting the caliber piece. Caliber piece 2 protects the adhesive inserted before the unit is driven in and keeps soil out of the inside 4 of the lock. The broken line along the inside of forward half 1 represents the later position of the other half 5 and the broken line along the inside of half 6 5 the later position of half 1. The direction along which piles are connected to one another is indicated by arrow R.

FIG. 2 illustrates how the adhesive can be introduced once the piles have been driven in. A caliber piece 2.1 is inserted in the forward half 1 of a driving unit 6. Mounted on the caliber piece is a pipe 7 with nozzles 8. During the pile driving, caliber piece 2.1 is positioned down to the final depth along with pipe 7 and its nozzles 8. The adhesive is injected into the inside 4 of the lock through nozzles 8 while caliber piece 2.1 is subsequently being withdrawn. The sheet-piling lock is closed off at the bottom.

Figure 3:
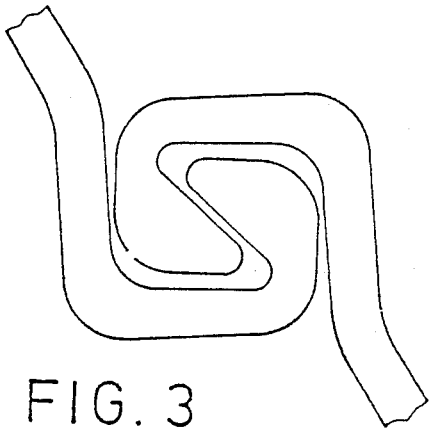
Figure 4:
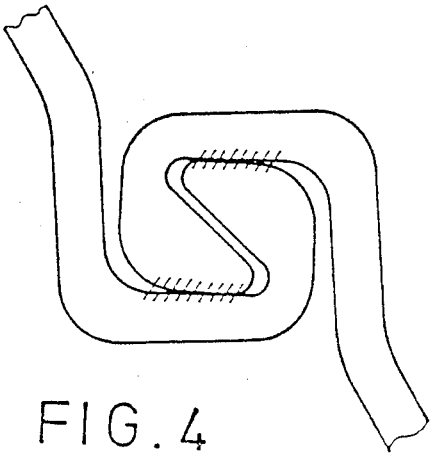
Figure 5:
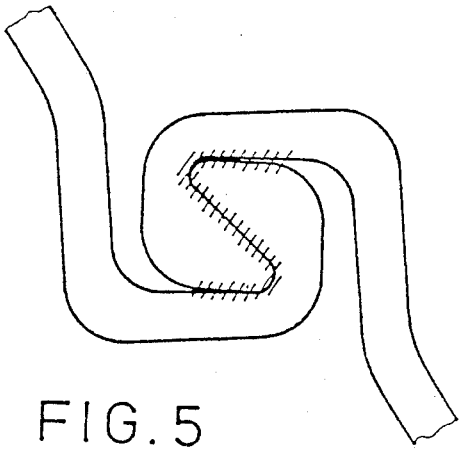
Figure 6:
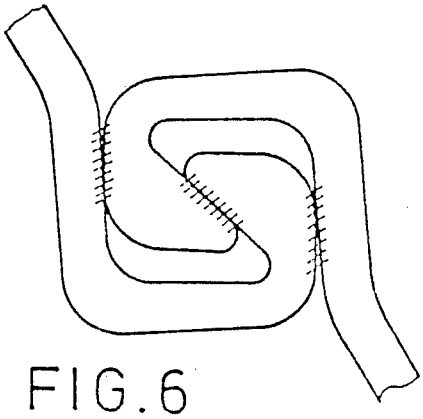
Figure 7:
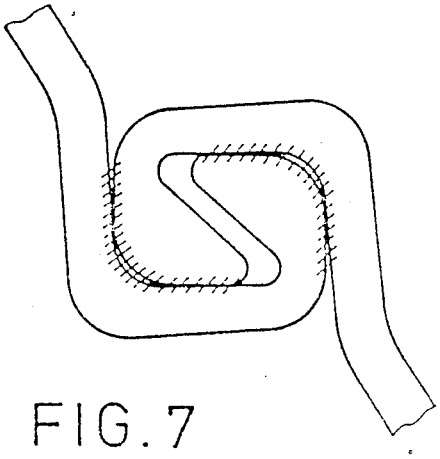

The position of the sheet-piling lock illustrated in FIG. 3 is ideal and has the requisite amount of play.

The sheet-piling locks illustrated in FIGS. 4 through 7 exhibit actual positions, with the particular contact surfaces, the active adhesive areas, that is, inside the lock indicated by hatching. The illustration is intended to show that there will be sufficient adhesive area in any conceivable position of the lock.

I claim:

1. A method for securing piling locks for transmitting an external thrust applied against one pile to adjacent piles, comprising the steps: providing at least a first pile and a second pile each with interlocking elements; applying adhesive to said interlocking elements of said first pile along surfaces of said elements to be contacted by corresponding mating interlocking elements on said second pile; placing a caliber member on the interlocking elements of said first pile to protect said adhesive and prevent soil from reaching the surfaces with adhesive thereon while said first pile is driven in; driving in said first pile with said caliber member in place; removing said caliber member from said first pile by drawing said caliber member upwards and out of the interlocking elements of said first pile after said first pile has been driven in; threading and meshing the interlocking elements of said second pile into the interlocking elements of said first pile; driving in said second pile; hardening said adhesive between contacting surfaces of the interlocking elements of said first pile and said second pile to form a force-fitted joint with said contacting surfaces extending grippingly into one another and cemented together by said adhesive and to hold the interlocking elements fixedly together so that said piles are not shiftable relative to one another, an external thrust applied to one pile being transmitted to the other adjacent pile through said interlocking elements for resisting said thrust by a plurality of piles.

2. A method for securing piling locks for transmitting an external thrust applied against one pile to adjacent piles, comprising the steps: providing at least a first pile and a second pile each with interlocking elements, the interlocking elements of said first pile having a bottom; closing said bottom of said interlocking elements of said first pile; placing a caliber member having a pipe with nozzles mounted thereon on the interlocking elements of said first pile to prevent soil from reaching surfaces on said interlocking elements of said first pile to be contacted by corresponding surfaces of the interlocking elements of said second pile; driving in said first pile with said caliber member in place; applying adhesive through said nozzles to said interlocking elements of said first pile along said surfaces to be contacted by corresponding mating interlocking elements of said second pile; extracting said caliber member from said first pile by drawing said caliber member upwards and out of the interlocking elements of said first pile while said adhesive is being applied simultaneously to said surfaces by said nozzles; threading and meshing the interlocking elements of said second pile into the interlocking elements of said first pile; driving in said second pile; hardening said adhesive between contacting surfaces of the interlocking elements of said first pile and said second pile to form a force-fitted joint with said contacting surfaces extending grippingly into one another and cemented together by said adhesive and to hold the interlocking elements fixedly together so that said piles are not shiftable relative to one another, an external thrust applied to one pile being transmitted to the other adjacent pile through said interlocking elements for resisting said thrust by a plurality of piles.

* * * * *